US006530516B1

(12) United States Patent
Ritter

(10) Patent No.: US 6,530,516 B1
(45) Date of Patent: Mar. 11, 2003

(54) SELF-DEPLOYING CARTON BOTTOM

(75) Inventor: Karl M. Ritter, Geneva, IL (US)

(73) Assignee: Stone Container Corporation, Chicago, IL (US)

( * ) Notice: Subject to any disclaimer, the term of this patent is extended or adjusted under 35 U.S.C. 154(b) by 0 days.

(21) Appl. No.: 09/990,407

(22) Filed: Nov. 21, 2001

(51) Int. Cl.[7] ..... B65D 5/36
(52) U.S. Cl. ..... 229/117; 229/183; 229/184
(58) Field of Search ..... 229/117, 117.01, 229/117.04, 183, 184

(56) References Cited

U.S. PATENT DOCUMENTS

| | | | | | |
|---|---|---|---|---|---|
| 2,018,171 | A | * | 10/1935 | Himes | 229/117.04 |
| 2,348,378 | A | * | 5/1944 | Goodyear | 229/117 |
| 2,572,123 | A | * | 10/1951 | Edtmiller | 229/117 |
| 3,069,063 | A | * | 12/1962 | King, Jr et al. | 229/117 |
| 3,501,081 | A | * | 3/1970 | Paige | 229/184 |
| 3,960,313 | A | | 6/1976 | Sax et al. | |
| 4,007,869 | A | | 2/1977 | Stolkin et al. | |
| 4,012,996 | A | | 3/1977 | Stolkin et al. | |
| 4,040,560 | A | * | 8/1977 | Grossman et al. | 229/117 |
| 4,119,265 | A | | 10/1978 | Dlugopolski | |
| 4,174,803 | A | | 11/1979 | Shrontz et al. | |
| 4,289,268 | A | * | 9/1981 | Paige | 229/117 |
| 4,767,051 | A | * | 8/1988 | Single | 229/184 |
| 4,899,929 | A | * | 2/1990 | Grollman | 229/117 |
| 5,887,782 | A | | 3/1999 | Mueller | 229/183 |
| 6,135,347 | A | * | 10/2000 | Mueller | 229/117 |
| 6,149,052 | A | * | 11/2000 | Mueller | 229/183 |

* cited by examiner

*Primary Examiner*—Gary E. Elkins
(74) *Attorney, Agent, or Firm*—Greenberg Traurig

(57) ABSTRACT

A carton is provided with an automatic bottom panel, which extends from a side panel, and has two converging reverse-scored fold lines, which extend outwardly from the side panel. One end flap featuring an angled score is folded up from the automatic bottom panel and is glued to its body panel. Adhesive is applied only above the diagonal folding score, leaving the unglued section free to fold in reverse in the bottom formation. The other end panel bottom flap is folded inwardly in the box joining process and a second of that flap with another diagonal score is folded in reverse for glue application. As the main panels are folded in the final gluing process the reverse folded glued section adheres to the outside surface of the previously mentioned major bottom flap. As the carton is brought into square during the erection process, the flaps self-form into a solid, full-overlapping bottom.

9 Claims, 6 Drawing Sheets

SELF-DEPLOYING CARTON BOTTOM

BACKGROUND OF THE INVENTION

1. Field of the Invention

The present invention is directed to cartons fabricated from paper, paperboard and/or corrugated paperboard. In particular, the present invention is directed to cartons that are configured for rapid set-up.

2. Prior Art

A rapid deployment carton is disclosed in Mueller, U.S. Pat. No. 5,887,782. The carton of Mueller '782 has an automatic bottom panel, which extends from a side panel, and has two converging reverse-scored fold lines, which extend outwardly from the side panel. End flaps are folded up form the automatic bottom and are adhesively connected to the end panels to form double ply side walls. One of the end flaps has a diagonal fold line, with portions of the flap above the diagonal fold line only being adhered to the end panel. The angles of the reverse scored fold lines are selected to allow the automatic bottom panel to be deployed from a folded position alongside the side and end panels to an assembled position perpendicular to the side and end panels, by displacing one side panel with respect to the other.

However, the Mueller '782 carton employs a bottom panel design which requires complex folding and gluing steps, in order to convert the raw die cut blank into a collapsed box.

It would be desirable to provide a carton, fabricated from paper, paperboard or corrugated paperboard, that has a self-deploying or at least partially self-deploying bottom structure, to enable rapid set-up from a collapsed configuration to a ready-to-use configuration.

It would further be desirable to provide such a carton, that has an improved bottom panel configuration, that provides for simpler folding and gluing of the bottom panels to the side walls, to create the collapsed carton.

These and other desirable characteristics of the present invention will become apparent in view of the present specification, including claims, and drawings.

SUMMARY OF THE INVENTION

The present invention comprises, in part, a carton, having a self-deploying bottom, comprising four serially connected rectangular sidewalls. Each sidewall is pivotably connected to the two sidewalls serially adjacent to it, so that the four sidewalls may be articulated between a substantially flattened orientation and an articulated set-up orientation, in which the four sidewalls are positioned in a rectangular configuration.

A first bottom panel is pivotably connected to a first one of the sidewalls, the first bottom panel having a first portion emanating along a first bottom panel first fold line from the first one of the sidewalls and a second portion, emanating from the first portion of the first bottom panel along a first bottom panel first fold line extending at an oblique angle to the first bottom panel first fold line.

A first deployment panel is pivotably connected to a second one of the side walls serially adjacent to the first one of the sidewalls, the first deployment panel having a first portion emanating along a first deployment panel first fold line from the second one of the sidewalls and a second portion, emanating from the first portion of the first deployment panel along a first deployment panel second fold line extending at an oblique angle to the first deployment panel first fold line.

The second portion of the first bottom panel and the second portion of the first deployment panel are pivotably connected along a first deployment panel third fold line extending substantially normal to at least one of the first bottom panel first fold line and the first deployment panel first fold line, when the carton is in its set-up configuration;

A second deployment panel is pivotably connected to a third one of the sidewalls, serially adjacent to the first one of the sidewalls, at an end of the first one of the sidewalls opposite the first deployment panel, the second deployment panel having a first portion emanating from the third one of the sidewalls along a second deployment panel first fold line, and a second portion emanating from the first portion of the second deployment panel along a second deployment panel second fold line.

An inside surface of the first portion of the first deployment panel is juxtaposed to and connected to an inside surface of the second one of the sidewalls.

An inside surface of the second portion of the second deployment panel is juxtaposed to and connected to an outside surface of the first bottom panel;

A second bottom panel is pivotably connected to a bottom edge of a fourth one of the sidewalls.

When the carton is in its flattened configuration, the first bottom panel is juxtaposed and parallel to the inside surface of the first sidewall, the first deployment panel is juxtaposed and parallel to the inside surface of the second sidewall, and the second portion of the second deployment panel is folded back upon the first portion of the second deployment panel;

Upon movement of the carton from its flattened configuration to the set-up configuration, the second portions of the first and second deployment panels pull the first bottom panel down to a position perpendicular to the sidewalls when the sidewalls attain their rectangular set-up configuration.

The second bottom panel is subsequently folded down to a position juxtaposed and parallel to and above the first bottom panel.

In a preferred embodiment of the invention, the carton further comprises at least two interlocking top panels emanating from top edges of at least two of the sidewalls, for creating a closure of the top of the carton.

In a preferred embodiment of the invention, the carton further comprises a top panel emanating from the top edge of each of the sidewalls, wherein at least two of the top panels have free edges operably configured to interlock with one another to provide a closure of the top of the carton.

Preferably, the first bottom panel and the first deployment panels are contiguous and monolithically formed. In an embodiment of the invention, the second bottom panel is discontiguously formed with respect to the first bottom panel. In an alternative embodiment of the invention, the first bottom panel, the first deployment panel and the second deployment panel are contiguously and monolithically formed.

The present invention also comprises, in part, a carton, having a self-deploying bottom, comprising four serially connected rectangular sidewalls.

Each sidewall is pivotably connected to the two sidewalls serially adjacent to it, so that the four sidewalls may be articulated from a substantially flattened orientation, to a set-up orientation, in which the four sidewalls are positioned in a rectangular configuration;

A first bottom panel is pivotably connected to a first one of the sidewalls, the first bottom panel having a first portion emanating along a first bottom panel first fold line from the first one of the sidewalls and a second portion, emanating from the first portion of the first bottom panel along a first bottom panel first fold line extending at an oblique angle to the first bottom panel first fold line.

A first deployment panel is pivotably connected to a second one of the side walls serially adjacent to the first one of the sidewalls, the first deployment panel having a first portion emanating along a first deployment panel first fold line from the second one of the sidewalls and a second portion, emanating from the first portion of the first deployment panel along a first deployment panel second fold line extending at an oblique angle to the first deployment panel first fold line.

The second portion of the first bottom panel and the second portion of the first deployment panel are pivotably connected along a first deployment panel third fold line extending substantially normal to at least one of the first bottom panel first fold line and the first deployment panel first fold line, when the carton is in its set-up configuration.

A second deployment panel is pivotably connected to a third one of the sidewalls, serially adjacent to the first one of the sidewalls, at an end of the first one of the sidewalls opposite the first deployment panel, the second deployment panel having a first portion emanating from the third one of the sidewalls along a second deployment panel first fold line, and a second portion emanating from the first portion of the second deployment panel along a second deployment panel second fold line.

The second portion of the second deployment panel is pivotably connected to the first bottom panel, along a second deployment panel third fold line to a third portion of the first bottom panel, that is in turn, connected to the first portion of the first bottom panel along a third bottom panel fold line that extends obliquely to the first bottom panel first and second fold lines.

An inside surface of the first portion of the first deployment panel is juxtaposed to and connected to an inside surface of the second one of the sidewalls.

An inside surface of the first portion of the second deployment panel is juxtaposed to and connected to an inside surface of the third one of the sidewalls.

A second bottom panel is pivotably connected to a bottom edge of a fourth one of the sidewalls.

When the carton is in its flattened configuration, the first and second portions of the first bottom panel are juxtaposed and parallel to the inside surface of the first sidewall, the third portion of the first bottom panel is folded back over the first portion of the first bottom panel, the first deployment panel is juxtaposed and parallel to the inside surface of the second sidewall, and the second portion of the second deployment panel is folded back upon the first portion of the second deployment panel.

Upon movement of the carton from its flattened configuration to the set-up configuration, the second portions of the first and second deployment panels pull the first bottom panel down to a position perpendicular to the sidewalls when the sidewalls attain their rectangular set-up configuration.

The second bottom panel is subsequently folded down to a position juxtaposed and parallel to and above the first bottom panel.

In this alternative embodiment of the invention, the carton further comprises at least two interlocking top panels emanating from top edges of at least two of the sidewalls, for creating a closure of the top of the carton. Preferably, the carton comprises a top panel emanating from the top edge of each of the sidewalls, wherein at least two of the top panels have free edges operably configured to interlock with one another to provide a closure of the top of the carton.

DETAILED DESCRIPTION OF THE DRAWINGS

Figure 1:
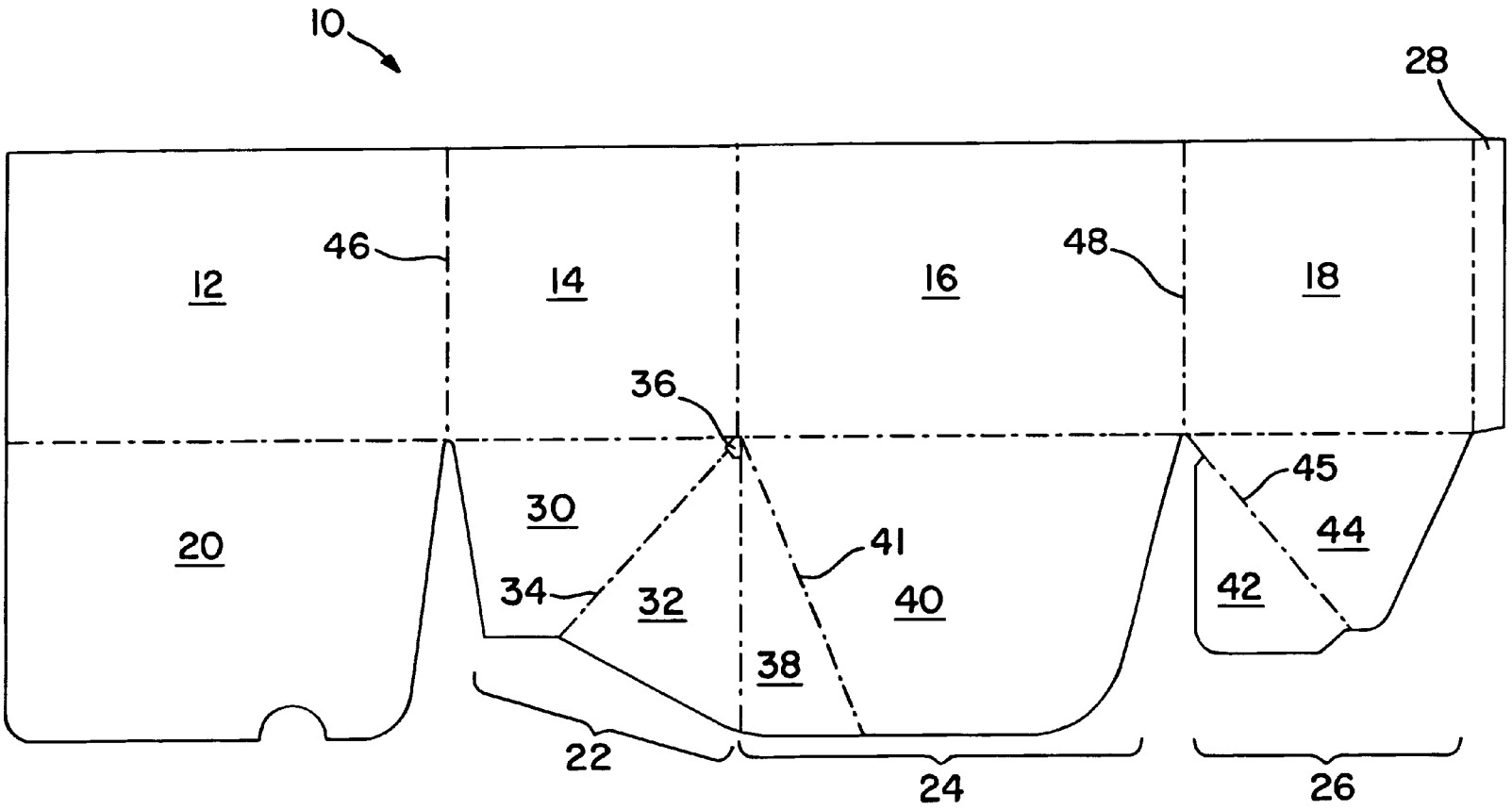
FIG. 1 is a plan view of a blank for forming a carton, having a self-deploying bottom, according to one embodiment of the invention.

While this invention is susceptible of embodiment in many different forms, there is shown in the drawings and will be described herein in detail, a specific embodiment, with the understanding that the present invention is to be considered as an exemplification of the principles of the invention and is not intended to limit the invention to the embodiment illustrated.

Each of the disclosed embodiments of the present invention is fabricated from paper, paperboard and/or corrugated paperboard, preferably corrugated paperboard.

FIG. 1 is a plan view of a blank for forming a carton, having a self-deploying bottom, according to one embodiment of the invention. Blank 10 is for a topless carton, and includes first wall panel 12, second wall panel 14, third wall panel 16 and fourth wall panel 18. First flap 20 extends from the bottom edge of first wall panel 12. Second flap 22, comprising panels 30 and 32, separated by fold line 34, emanates from the bottom edge of second wall panel 14. Third flap 24, comprising panels 38 and 40, separated by fold line 41, emanates from the bottom edge of third wall panel 16. Fourth flap 26, comprising panels 42 and 44, separated by fold line 45, emanates from the bottom edge of fourth wall panel 18. Die cut hole 36 may be provided at the root of fold line 34, to alleviate bunching of the corrugated material, during articulation of the carton. Second flap 22 and third flap 24 are contiguously formed. Strip 28 is provided, for adhesive attachment to an outer or inner surface of first panel 12.

To form a carton from blank 10, second flap 22 and third flap 24 are folded up and over second wall panel 14 and third wall panel 16, respectively. The juxtaposed surfaces of second wall panel 14 and panel 30 are adhesively affixed to one another. Fourth flap 26 is folded up and over fourth wall panel 18. Panel 42 is then folded back upon panel 44, about fold line 45, so that panel 44 is sandwiched between fourth wall panel 18 and panel 42. Adhesive is then applied to the upwardly facing side of panel 42. First wall panel 12, with panel 20 folded up, is folded about fold line 46, to overlie second wall panel 14 and a portion of third wall panel 16, and folded up flaps 22, 24, respectively. Fourth wall panel 18, with the glued side of panel 42 facing up, is folded over, about fold line 48, so that the adhesively coated side of panel 42 is placed against and glued to the upwardly facing bottom side of panel 40. Prior to folding fourth wall panel 18 over, adhesive is also applied to the upwardly facing side of strip 28, so that when fourth wall panel 18 is folded about fold line 48, strip 28 is placed down on the outside surface of first wall panel 12.

Figure 2:
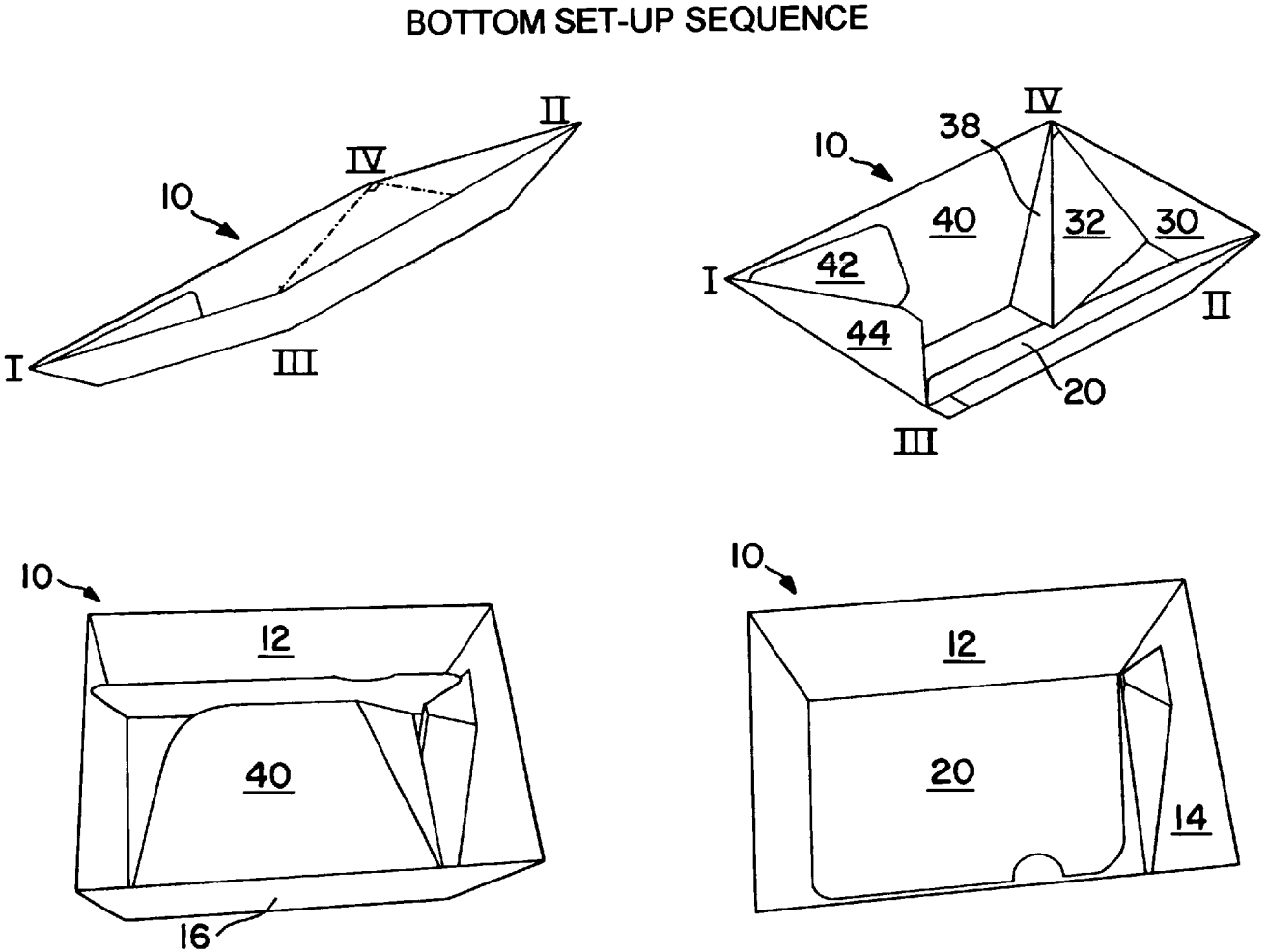
FIG. 2 shows the sequence for forming a carton, from a blank according to FIG. 1, which has been appropriately folded and glued.

This results in a collapsed, fully glued carton blank 10 as shown in the upper left of the four views of FIG. 2. By pressing distally positioned corners I and II of blank 10 toward one another, corners III and IV are forced away from one another, as seen in the upper right of FIG. 2. As the four wall panels move from a flattened orientation, to a rectangular configuration, panel 26 unfolds and flattens, panel 44 pulls upon panel 42, in turn pulling panel 40 from its position folded generally parallel to and against third wall panel 16, to a position over and parallel to panel 44, and perpendicular to first-through-fourth wall panels 12, 14, 16 and 18, as shown from above in the lower left corner of FIG. 2. Finally, panel 20 is pushed down over panel 40, to complete the set-up of carton 10. A semicircular notch may be provided in a free edge of panel 20, to facilitate insertion of fingers under panel 20, when it is desired to collapse and flatten the carton.

Figure 3:
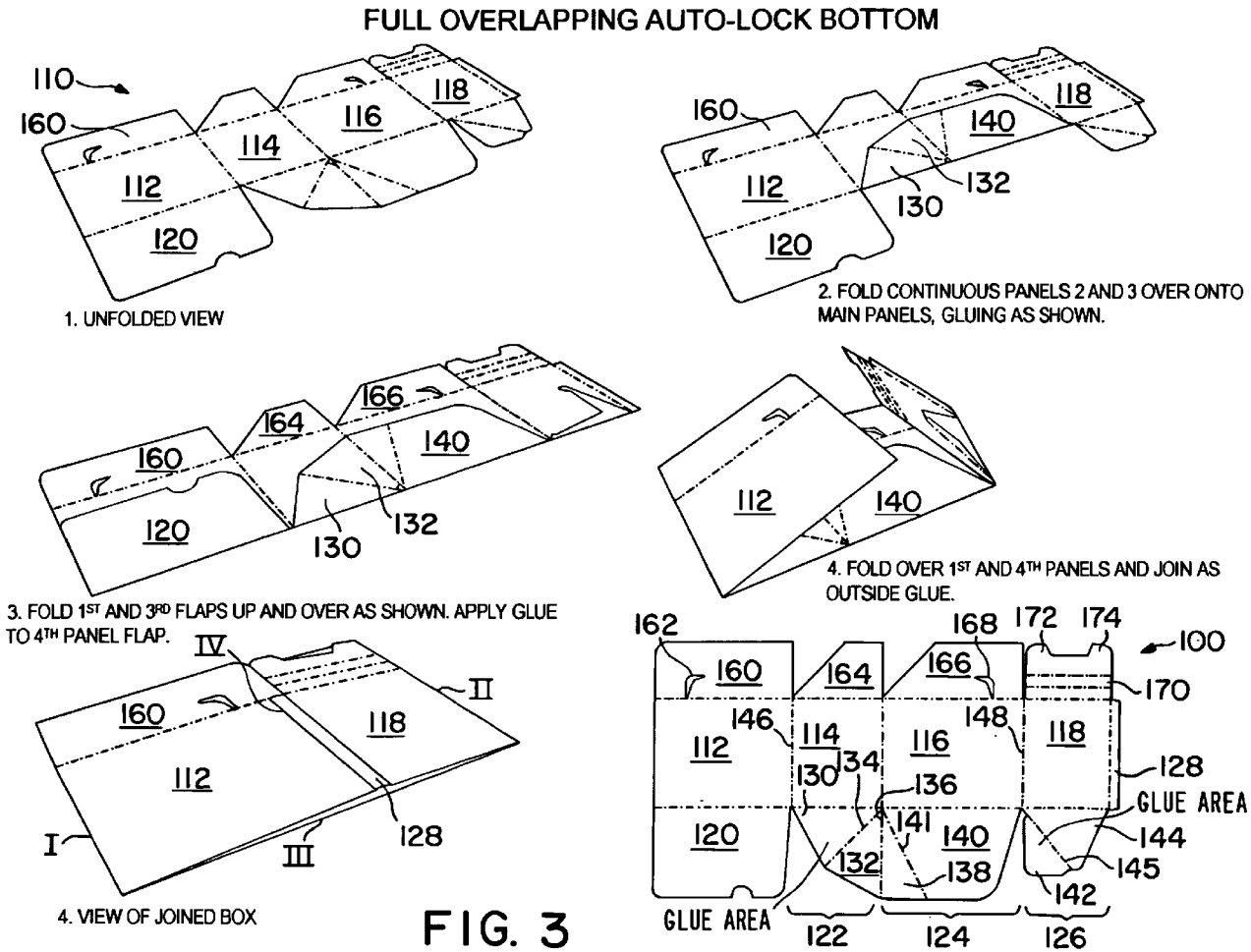
FIG. 3 illustrates an alternative embodiment of the present invention, in which the carton has interlocking top panels, to form a cover.

FIG. 3 illustrates an alternative embodiment of the present invention, in which the carton has interlocking top panels, to form a cover. Blank 110 comprises first wall panel 112, second wall panel 114, third wall panel 116 and fourth wall panel 118. First flap 120 extends from the bottom edge of first wall panel 112. Second flap 122, comprising panels 130 and 132, separated by fold line 134, emanates from the bottom edge of second wall panel 114. Third flap 124, comprising panels 138 and 140, separated by fold line 141, emanates from the bottom edge of third wall panel 116. Fourth flap 126, comprising panels 142 and 144, separated by fold line 145, emanates from the bottom edge of fourth wall panel 118. Die cut hole 136 may be provided at the root of fold line 134, to alleviate bunching of the corrugated material, during articulation of the carton. Second flap 122 and third flap 124 are contiguously formed. Strip 128 is provided, for adhesive attachment to an outer or inner surface of first panel 112.

Blank 110 is also provided with first top flap 160, with L-shaped opening 162; second top flap 164, third top flap 166 with L-shaped opening 166 and fourth top flap 168, with trapezoidal notch or recess 170.

To form a carton from blank 110, second flap 122 and third flap 124 are folded up and over second wall panel 114 and third wall panel 116, respectively. The juxtaposed surfaces of second wall panel 114 and panel 130 are adhesively affixed to one another. Fourth flap 126 is folded up and over fourth wall panel 118. Panel 142 is then folded back upon panel 144, about fold line 145, so that panel 144 is sandwiched between fourth wall panel 118 and panel 142. Adhesive is then applied to the upwardly facing side of panel 142. First wall panel 112, with panel 120 folded up, is folded about fold line 146, to overlie second wall panel 114 and a portion of third wall panel 116, and folded up flaps 122, 124, respectively. Fourth wall panel 118, with the glued side of panel 142 facing up, is folded over, about fold line 148, so that the adhesively coated side of panel 142 is placed against and glued to the upwardly facing bottom side of panel 140. Prior to folding fourth wall panel 118 over, adhesive is also applied to the upwardly facing side of strip 128, so that when fourth wall panel 118 is folded about fold line 148, strip 128 is placed down on the outside surface of first wall panel 112.

This results in a collapsed, fully glued carton blank 110 as shown in the lower left view of FIG. 3. By pressing distally positioned corners I and II of blank 110 toward one another, corners III and IV are forced away from one another. As the four wall panels move from a flattened orientation, to a rectangular configuration, panel 126 unfolds and flattens, panel 144 pulls upon panel 142, in turn pulling panel 140 from its position folded generally parallel to and against third wall panel 116, to a position over and parallel to panel 144, and perpendicular to first-through-fourth wall panels 112, 114, 116 and 118. Finally, panel 120 is pushed down over panel 140, to complete the set-up of carton 110.

After carton 110 has been filled, the open top is closed, by first folding over second top flap 164, and then first and third top flaps 160 and 166, respectively. Finally, fourth top flap 170 is folded over, and tabs 172 and 174 are tucked into apertures 168, 162, respectively.

Figure 4:
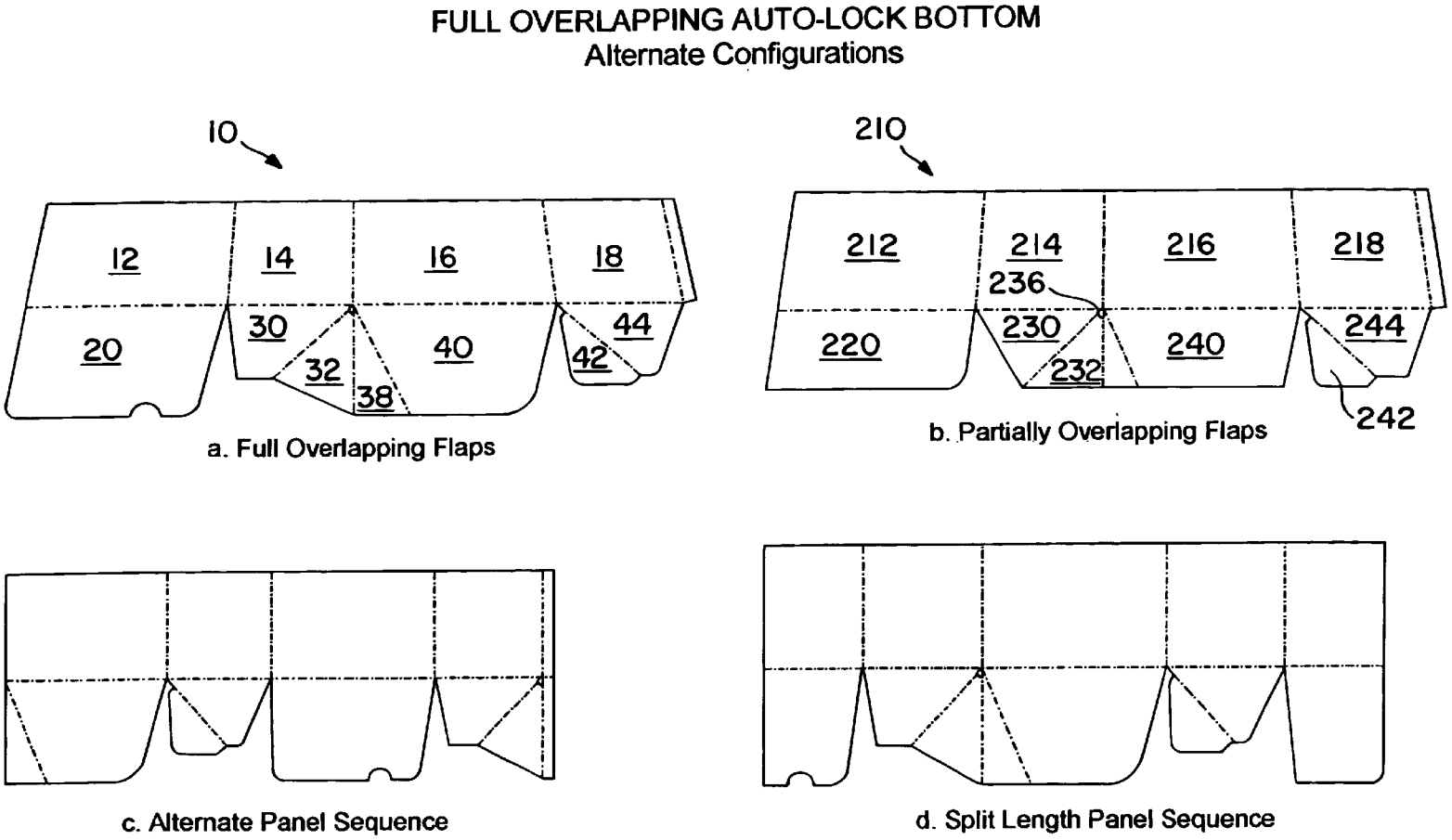
FIG. 4 illustrates, in isometric views, four alternative configurations of carton blanks for lidless cartons according to the present invention.

In the present invention, the amount of overlap of the bottom flaps may be full, as shown in FIGS. 1–3 and 4 (left side), or partial as shown in FIG. 4 (right side). By full overlap, it is meant that each of panel 20 (or 120) and panel 40 (or 140) extend substantially across the entire width of the bottom of the set-up carton. In other words, panels 20 and 40 each have a width that is almost equal to the side-to-side width of second wall panel 14 and fourth wall panel 18. The alternative construction of FIG. 4*b*, a partial overlap, panels 120 and 140 has a width (up and down direction in FIG. 4*b*) that is substantially less than the (side-to-side) width of respective first and third wall panels 212 and 216. FIG. 4 also shows two other possible embodiments. In the lower left of FIG. 4, the sequence of panels along the length of the blank has been indexed by two panels (i.e., the unattached bottom panel and its corresponding length panel are the third panels, left to right, as opposed to being the leftmost panels). In the lower right of FIG. 4, a blank is formed, in which the length panel from which the unattached bottom panel emanates has been split in two (the seam for forming the carton is in the middle of a length panel, instead of being located at one of the corners of the erected carton). Aside from these differences, once formed into cartons, the operation of the cartons from these blanks is substantially the same as described with respect to the previously discussed embodiments.

The embodiments of FIGS. 1–4 are provided with self-deploying bottoms, but panels 30 and 32 (or 130 and 132 or 230 and 232), which remain vertical, only along side second wall panels 14, 114 and 214, respectively, after set-up of the respective embodiments, do not provide significant stacking reinforcement to the set-up cartons.

Figure 5:
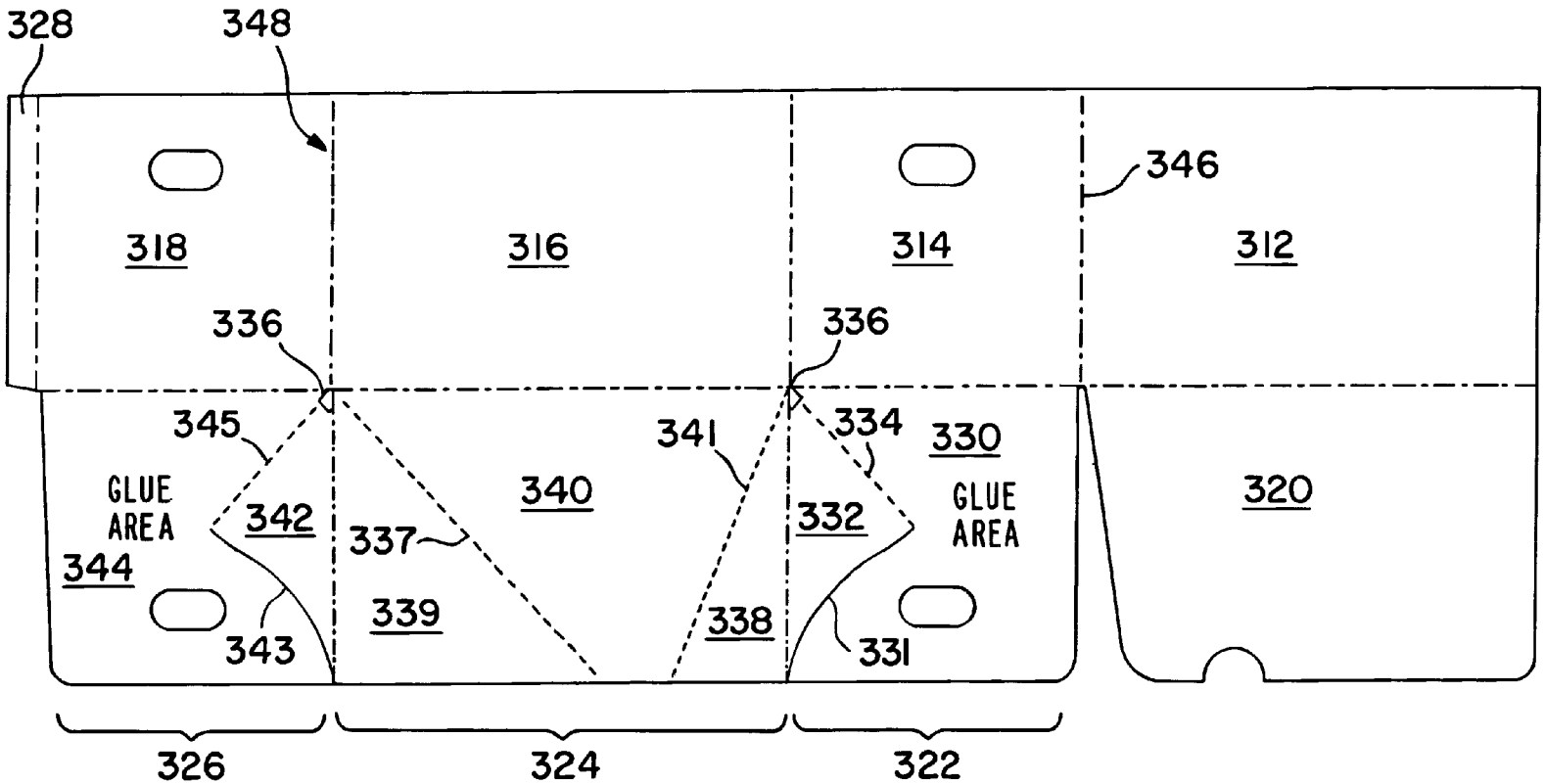
FIG. 5 is a blank for another alternative embodiment of the invention, in which additional stacking strength is provided.
Figure 6:
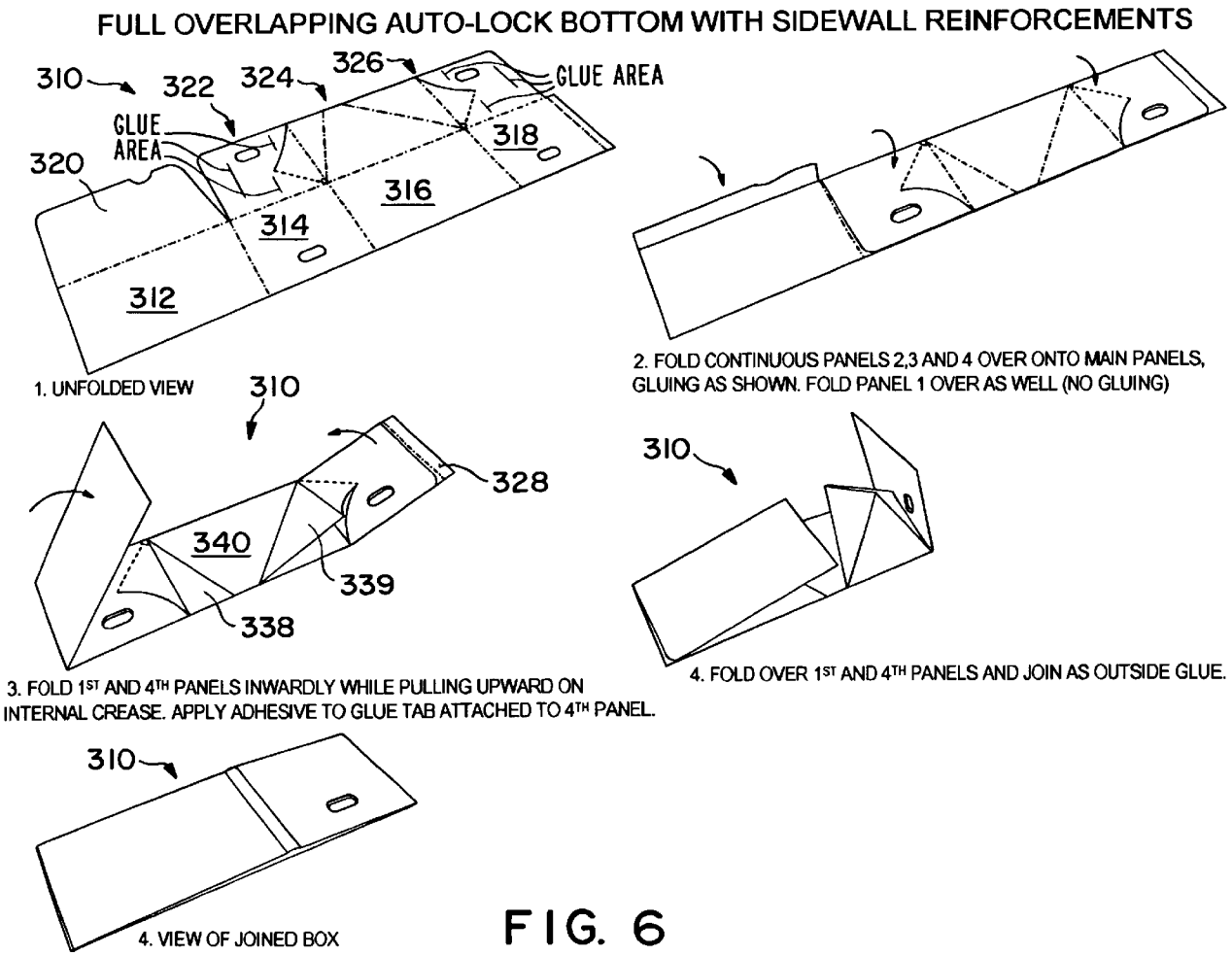
FIG. 6 illustrates the steps in the gluing and folding of the blank of the embodiment of FIG. 5.

Accordingly, FIGS. 5 and 6 illustrate a further alternative embodiment of the invention, in which stacking reinforcement is provided in addition to the self-deploying bottom of the previously described embodiments.

FIG. 5 illustrates an alternative embodiment of the present invention, in which the carton has inner reinforcing sidewall panels. Blank 310 comprises first wall panel 312, second wall panel 314, third wall panel 316 and fourth wall panel 318. First flap 320 extends from the bottom edge of first wall panel 312. Second flap 322, comprising panels 330 and 332, separated by fold line 334 and cut 331, emanates from the bottom edge of second wall panel 314. Third flap 324, comprising panels 338, 340 and 339, separated by fold lines 341 and 337, respectively, emanates from the bottom edge of third wall panel 316. Fourth flap 326, comprising panels 342 and 344, separated by fold line 345 and cut 343, emanates from the bottom edge of fourth wall panel 318. Die cut holes 336 may be provided at the roots of fold lines 334 and 345, to alleviate bunching of the corrugated material, during articulation of the carton. Second flap 322, third flap 324 and fourth flap 326 are contiguously formed. Strip 328 is provided, for adhesive attachment to an outer or inner surface of first panel 312.

To form a carton from blank 310, second flap 322, third flap 324 and fourth flap 325 are folded up and over second wall panel 314, third wall panel 316, and fourth wall panel 318, respectively. The juxtaposed surfaces of second wall panel 314 and panel 330 are adhesively affixed to one another, as shown in the upper left of FIG. 6. Similarly, the juxtaposed surfaces of fourth wall panel 318 and panel 344 are adhesively affixed to one another, as shown in the upper left of FIG. 6. First wall panel 312, with panel 320 folded up, is folded about fold line 346, to overlie second wall panel 314 and a portion of third wall panel 316, and folded up flaps 322, 324, respectively. Fourth wall panel 318 is folded over, about fold line 348 Prior to folding fourth wall panel 318 over, adhesive is also applied to the upwardly facing side of strip 328, so that when fourth wall panel 318 is folded about fold line 348, strip 328 is placed down on the outside surface of first wall panel 312. This results in the flattened, collapsed carton 310 of the lower left of FIG. 6.

To set-up the carton, the distal edges are pressed toward one another, as in the other embodiments, panels 342 and 332 pull on panels 339, 338 respectively, to, in turn, pull down panel 340. When the wall panels reach a rectangular configuration, panel 324 becomes flattened, and permits panel 320 to be pushed down on top of it to complete set-up of the carton.

The embodiment of FIGS. 5 and 6 is provided with enhanced stacking strength in that panels 330 and 344 are substantially whole, extending completely from top to bottom alongside panels 314 and 318, respectively, thus providing that two of the side walls of the carton have a double thickness.

While the carton of FIGS. 5 and 6 is shown, without top panels, it is understood that a further alternative embodiment, incorporating the top panels of the embodiments of FIG. 3, may be provided, and would be within the scope of the present invention.

The foregoing description and drawings merely explain and illustrate the invention, and the invention is not limited except insofar as the appended claims are so limited, as those skilled in the art who have the disclosure before them will be able to make modifications and variations therein without departing from the scope of the invention.

I claim:

1. A carton, having a self-deploying bottom, comprising:

four serially connected rectangular sidewalls, each sidewall being pivotably connected to the two sidewalls serially adjacent to it, so that the four sidewalls may be articulated between a substantially flattened orientation and an articulated set-up orientation, in which the four sidewalls are positioned in a rectangular configuration;

a first bottom panel pivotably connected to a first one of the sidewalls, the first bottom panel having a first portion emanating along a first bottom panel first fold line from the first one of the sidewalls and a second portion, emanating from the first portion of the first bottom panel along a first bottom panel first fold line extending at an oblique angle to the first bottom panel first fold line;

a first deployment panel pivotably connected to a second one of the side walls serially adjacent to the first one of the sidewalls, the first deployment panel having a first portion emanating along a first deployment panel first fold line from the second one of the sidewalls and a second portion, emanating from the first portion of the first deployment panel along a first deployment panel second fold line extending at an oblique angle to the first deployment panel first fold line;

the second portion of the first bottom panel and the second portion of the first deployment panel being pivotably connected along a first deployment panel third fold line extending substantially normal to at least one of the first bottom panel first fold line and the first deployment panel first fold line, when the carton is in its set-up configuration;

a second deployment panel pivotably connected to a third one of the sidewalls, serially adjacent to the first one of the sidewalls, at an end of the first one of the sidewalls opposite the first deployment panel, the second deployment panel having a first portion emanating from the third one of the sidewalls along a second deployment panel first fold line, and a second portion emanating from the first portion of the second deployment panel along a second deployment panel second fold line;

an inside surface of the first portion of the first deployment panel being juxtaposed to and connected to an inside surface of the second one of the sidewalls;

an inside surface of the second portion of the second deployment panel being juxtaposed to and connected to an outside surface of the first bottom panel;

a second bottom panel, pivotably connected to a bottom edge of a fourth one of the sidewalls;

whereupon when the carton is in its flattened configuration, the first bottom panel is juxtaposed and parallel to the inside surface of the first sidewall, the first deployment panel is juxtaposed and parallel to the inside surface of the second sidewall, and the second portion of the second deployment panel is folded back upon the first portion of the second deployment panel;

upon movement of the carton from its flattened configuration to the set-up configuration, the second portions of the first and second deployment panels pull the first bottom panel down to a position perpendicular to the sidewalls when the sidewalls attain their rectangular set-up configuration, the second bottom panel being subsequently folded down to a position juxtaposed and parallel to and above the first bottom panel.

2. The carton according to claim 1, further comprising at least two interlocking top panels emanating from top edges of at least two of the sidewalls, for creating a closure of the top of the carton.

3. The carton according to claim 2, further comprising a top panel emanating from the top edge of each of the sidewalls, wherein at least two of the top panels have free edges operably configured to interlock with one another to provide a closure of the top of the carton.

4. The carton according to claim 1, wherein the first bottom panel and the first deployment panels are contiguous and monolithically formed.

5. The carton according to claim 1, wherein the second bottom panel is discontiguously formed with respect to the first bottom panel.

6. The carton according to claim 1, wherein the first bottom panel, the first deployment panel and the second deployment panel are contiguously and monolithically formed.

7. A carton, having a self-deploying bottom, comprising:

four serially connected rectangular sidewalls, each sidewall being pivotably connected to the two sidewalls serially adjacent to it, so that the four sidewalls may be articulated from a substantially flattened orientation, to a set-up orientation, in which the four sidewalls are positioned in a rectangular configuration;

a first bottom panel pivotably connected to a first one of the sidewalls, the first bottom panel having a first portion emanating along a first bottom panel first fold line from the first one of the sidewalls and a second portion, emanating from the first portion of the first bottom panel along a first bottom panel first fold line extending at an oblique angle to the first bottom panel first fold line;

a first deployment panel pivotably connected to a second one of the side walls serially adjacent to the first one of the sidewalls, the first deployment panel having a first portion emanating along a first deployment panel first fold line from the second one of the sidewalls and a second portion, emanating from the first portion of the first deployment panel along a first deployment panel second fold line extending at an oblique angle to the first deployment panel first fold line;

the second portion of the first bottom panel and the second portion of the first deployment panel being pivotably connected along a first deployment panel third fold line extending substantially normal to at least one of the first bottom panel first fold line and the first deployment panel first fold line, when the carton is in its set-up configuration;

a second deployment panel pivotably connected to a third one of the sidewalls, serially adjacent to the first one of the sidewalls, at an end of the first one of the sidewalls opposite the first deployment panel; the second deployment panel having a first portion emanating from the third one of the sidewalls along a second deployment panel first fold line, and a second portion emanating from the first portion of the second deployment panel along a second deployment panel second fold line;

the second portion of the second deployment panel being pivotably connected to the first bottom panel, along a second deployment panel third fold line to a third portion of the first bottom panel, that is in turn, connected to the first portion of the first bottom panel along a third bottom panel fold line that extends obliquely to the first bottom panel first and second fold lines;

an inside surface of the first portion of the first deployment panel being juxtaposed to and connected to an inside surface of the second one of the sidewalls;

an inside surface of the first portion of the second deployment panel being juxtaposed to and connected to an inside surface of the third one of the sidewalls;

a second bottom panel, pivotably connected to a bottom edge of a fourth one of the sidewalls;

whereupon when the carton is in its flattened configuration, the first and second portions of the first bottom panel are juxtaposed and parallel to the inside surface of the first sidewall, the third portion of the first bottom panel is folded back over the first portion of the first bottom panel, the first deployment panel is juxtaposed and parallel to the inside surface of the second sidewall, and the second portion of the second deployment panel is folded back upon the first portion of the second deployment panel;

upon movement of the carton from its flattened configuration to the set-up configuration, the second portions of the first and second deployment panels pull the first bottom panel down to a position perpendicular to the sidewalls when the sidewalls attain their rectangular set-up configuration, the second bottom panel being subsequently folded down to a position juxtaposed and parallel to and above the first bottom panel.

8. The carton according to claim 7, further comprising at least two interlocking top panels emanating from top edges of at least two of the sidewalls, for creating a closure of the top of the carton.

9. The carton according to claim 8, further comprising a top panel emanating from the top edge of each of the sidewalls, wherein at least two of the top panels have free edges operably configured to interlock with one another to provide a closure of the top of the carton.

* * * * *